US010366875B2

(12) United States Patent
Krüger et al.

(10) Patent No.: US 10,366,875 B2
(45) Date of Patent: Jul. 30, 2019

(54) DAMPING RING

(71) Applicant: Xylem IP Management S.à r.l., Senningerberg (LU)

(72) Inventors: Friedhelm Krüger, Lemgo (DE); Peer Krüger, Bielefeld (DE); Sven Kämmerer, Bad Salzuflen (DE)

(73) Assignee: XYLEM IP MANAGEMENT S.À R.L., Luxembourg (LU)

( * ) Notice: Subject to any disclaimer, the term of this patent is extended or adjusted under 35 U.S.C. 154(b) by 0 days.

(21) Appl. No.: 16/076,803

(22) PCT Filed: Jan. 27, 2017

(86) PCT No.: PCT/EP2017/051843
§ 371 (c)(1),
(2) Date: Aug. 9, 2018

(87) PCT Pub. No.: WO2017/137270
PCT Pub. Date: Aug. 17, 2017

(65) Prior Publication Data

US 2019/0019665 A1 Jan. 17, 2019

(30) Foreign Application Priority Data

Feb. 12, 2016 (EP) ..... 16155529

(51) Int. Cl.
*H01J 5/48* (2006.01)
*H01J 61/34* (2006.01)
*H01J 61/50* (2006.01)

(52) U.S. Cl.
CPC ..... *H01J 61/34* (2013.01); *H01J 5/48* (2013.01); *H01J 61/50* (2013.01)

(58) Field of Classification Search
CPC ..... H01J 61/34; H01J 5/48; H01J 61/50
(Continued)

(56) References Cited

U.S. PATENT DOCUMENTS 4,255,383 A 3/1981 Schenck et al.
5,166,527 A 11/1992 Solymar
(Continued)

FOREIGN PATENT DOCUMENTS

EP 3279920 A1 * 2/2018 ..... H01J 61/34
KR 101329234 B1 11/2013

OTHER PUBLICATIONS

International Search Report and Written Opinion for International Application No. PCT/EP2017/0051843, dated Apr. 7, 2017—14 pages.

*Primary Examiner* — Donald L Raleigh
(74) *Attorney, Agent, or Firm* — RatnerPrestia

(57) ABSTRACT

A UV radiator unit includes an elongated gas discharge lamp with an essentially cylindrical UV transparent lamp body with sealed ends, which encloses a gas volume. The lamp body defines a longitudinal axis and has an outer diameter. A UV transparent sleeve tube with an inner diameter, which surrounds the lamp body and wherein the inner diameter is larger than the outer diameter of the lamp body. At least one damping ring is interposed between the lamp body and the sleeve tube. The damping ring includes a first side element, a second side element and at least one connecting portion. An axial distance is provided between the first side element and the second side element. The at least one connecting portion physically connects the first side element and the second side element.

19 Claims, 3 Drawing Sheets

Figure 1:
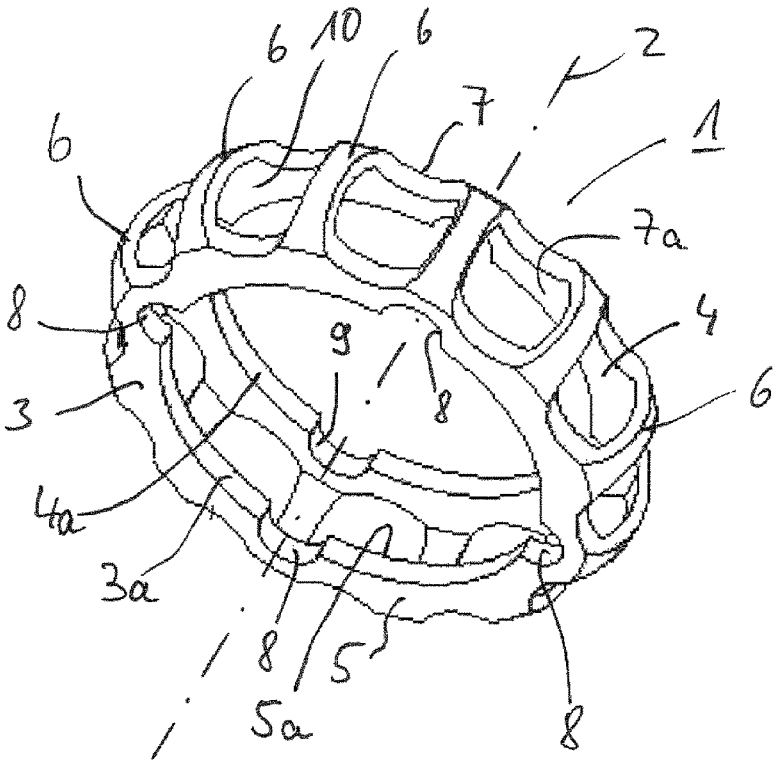

(58) Field of Classification Search
USPC ..... 313/238
See application file for complete search history.

(56) References Cited

U.S. PATENT DOCUMENTS 7,423,367 B2 * 9/2008 Lantis ..... H01J 5/48
313/17
8,314,538 B2 * 11/2012 Hombach ..... H01J 9/247
313/238

* cited by examiner

DAMPING RING

CROSS-REFERENCE TO RELATED APPLICATIONS

This patent application is a U.S. National Phase Patent Application of PCT Application No.: PCT/EP2017/051843, filed Jan. 27, 2017, which claims priority to European Patent Application No. 16155529.7, filed Feb. 12, 2016, each of which is incorporated by reference herein in its entirety.

FIELD OF THE INVENTION

The present invention relates to an ultraviolet (UV) radiator unit and to the use of a damping ring.

BACKGROUND OF THE INVENTION

UV radiator units for the treatment of gases and especially of liquids like water are widely known. The UV radiation, which is produced by these units, is useful to disinfect water, for example drinking water, which contains bacteria and viruses, and wastewater, which needs to be disinfected before being released to the environment. UV-radiation can also be used to physically crack certain chemical compounds like halogenated carbohydrates, drug traces in water and the like.

The disinfection potential of ultraviolet radiation can also be used to disinfect ballast water, which is discharged from ships in order to prevent foreign species from entering local water bodies in ports and rivers.

Such UV radiator units most commonly comprise and elongated gas discharge lamp with an essentially cylindrical lamp body, which is made from a quartz tube. At both ends, the lamp body is sealed and carries electrodes. The inside of the lamp is filled with a gas, which contains a small amount of mercury. Between the electrodes, there is a volume, in which the gas discharge develops such that the mercury is exited and emits ultraviolet radiation of the desired wavelength, the so-called germicidal wavelength.

These lamps need to be protected from direct contact with the surrounding water, mainly because of the operating temperature, which shall be maintained in a certain temperature interval for an efficient UV output, but also because of the potential contamination of the surface with non-transparent material, which reduces the UV output of the lamp. Finally, the lamp itself should be protected from mechanical damage. To this end, a sleeve tube, which is also manufactured from UV-transparent quartz material, surrounds the UV-lamp and prevents the lamp from coming into contact with the fluid to be treated.

The position of the lamp inside the sleeve tube has some effect on the operating conditions. In the case of cold water surrounding the sleeve tube, it is helpful to position the lamp in the centre of the sleeve tube, i.e. concentrically, so that no area of the lamp comes into close proximity of the sleeve tube, because such proximity could lead to cooling of the lamp in that area and ends to a reduction of the mercury vapour pressure inside the lamp. This could reduce the UV-output.

In the case of mechanical stress, mainly arising from vibrations or shock events, there must also be some protection to prevent the lamp from hitting the sleeve tube, which might result in the breakage of the sleeve tube, the lamp, or both.

Such operating conditions, which lead to mechanical stress events, arise if the ultraviolet lamp unit is used in portable devices or in mobile devices, like containers for use disaster areas for mobile disinfection or decontamination use, or in ships during the discharge of ballast water, because there may be vibrating pumps and tubes which impose vibration to the lamp units, and because of the high velocity of the water flow itself.

One example of an ultraviolet lamp, which is centred inside a sleeve tube by centering or damping rings, is known from U.S. Pat. No. 5,166,527, which is considered the closest prior art. In this document, centering rings preferably of a synthetic plastic material are located on the arc tube, which is the lamp body. The rings co-axially surround the tube and frictionally engage and support the tube, and assist in centering the tube within the sleeve.

While this arrangement is useful for centering the lamp inside the sleeve, is has been found that rings of plastic material, of rubber or similar devices are not sufficient to protect the lamp from mechanical damage, especially in mobile applications.

SUMMARY OF THE INVENTION

It is therefore an object of the present invention to provide a UV lamp unit, which is improved in mechanical resistance with respect to shock and vibration. It another object of the present invention to provide a new damping ring to be positioned between the lamp body and the quartz tube, which can absorb the mechanical stress and at the same time is durable under the operating conditions.

These objects are achieved by a UV lamp unit and by the use of a damping ring.

An effective dampening of shocks and vibrations is achieved because the damping ring comprises a first side element and a second side element, wherein an axial distance is provided between the first side element and the second side element, and at least one connecting portion, which physically connects the first side element and the second side element. In this configuration, the ring can flex or compress under load and is nonetheless of a durable shape.

The two side elements are preferably annular or ring-shaped and especially of a flat basic configuration. It is furthermore preferred that the annular or ring-shaped side elements are dimensioned such that the lamp body can be introduced into the side elements so that the side elements surround the lamp body. A gap between the side elements, more precisely the inner surface of the side elements, and the lamp body is preferably very small or zero, so that the lamp body cannot move inside the side elements in a radial direction under mechanical stress like vibrations or shaking.

It is preferred if the damping ring has at least one radially inwardly facing surface which frictionally engages the outer surface of the lamp body so that during assembly and in operation, the ring may be positioned as required and remains at that position.

In a preferred embodiment the at least one connecting portion constitutes the portions of the largest diameter of the ring. In this case, enhanced flexibility is achieved.

It is preferred if the diameter of the ring is matched to the inner diameter of the sleeve tube in a way that the connecting portions touch the sleeve tube or that a gap of less than 1 mm is provided between the connecting portions and the inner surface of the sleeve tube. In this case, the concentric centring of the lamp body inside the sleeve tube is optimized.

In a preferred embodiment the frictional engagement of the ring with the lamp body is balanced against a frictional engagement of the ring with the sleeve tube such that the static friction between the ring and the lamp body is larger than the static friction between the ring and the sleeve tube. In this way, the position of the ring on the lamp body is reliably maintained when mounting the lamp body into the sleeve tube.

In a preferred embodiment a plurality of connecting portions is provided, and openings are provided between the connecting portions such that the openings allow for transmission of UV light in radial direction from the lamp body to the sleeve tube. In this case, the UV loss in the area of the ring is reduced and hence the efficiency of the unit is increased.

In a preferred embodiment the connecting portions are arch-shaped and attached to the respective side elements, where the connecting portions have a basic width in circumferential direction, and the width of the connecting portions has a minimum value at a point that is located centrally between the two side elements. This feature allows a progressive characteristic of the resilience of the ring.

It is preferred if the point of minimum width of the connecting portions is also the point of the maximum outer diameter of the ring. In this case, the friction upon contact of the ring with the sleeve tube is minimized.

In a preferred embodiment the radially inwardly facing surfaces of the ring carry recesses, which constitute spaces in which the inner surfaces do not contact the lamp body. With this feature, electrical wires can be guided through the gap between the lamp body and the sleeve tube from the free end of the lamp body to the electric socket, and the wires can be located in the recesses to ensure a certain position of the wires.

In the use of a damping ring in a gap between lamp body and a sleeve tube of an ultraviolet radiator unit for the purpose of centering and dampening the lamp body inside the sleeve tube, positive elastic and dampening characteristics are achieved because a first side element and a second side element are provided, wherein an axial distance is arranged between the first side element and the second side element, and at least one connecting portion is provided, which physically connects the first side element and the second side element.

It is preferred if the at least one connecting portion constitute the portions of the largest outer diameter of the ring. Thus, elastic properties of the ring are improved.

It is preferred if a plurality of connecting portions is provided, and openings are provided between the connecting portions such that the openings allow for transmission of UV light in radial direction from the lamp body to the sleeve tube. This way, the ring does not block transmission in radial direction to an undesirable extent.

If the connecting portions are arch-shaped and attached to the respective side elements, where the connecting portions have a basic width in circumferential direction, and the width of the connecting portions has a minimum value at a point that is located centrally between the two side elements, progressive spring characteristics in radial direction are achieved.

It is preferred if the point of minimum width of the connecting portions is also the point of the maximum outer diameter of the ring. This makes the ring softer upon initial compression in radial direction.

In a preferred embodiment, the radially inwardly facing surfaces of the ring carry recesses, which constitute spaces in which the inner surfaces do not contact the lamp body. This allows for more flexible mounting options of the ring in a UV lamp unit.

BRIEF DESCRIPTION OF THE DRAWING FIGURES

Figure 2:
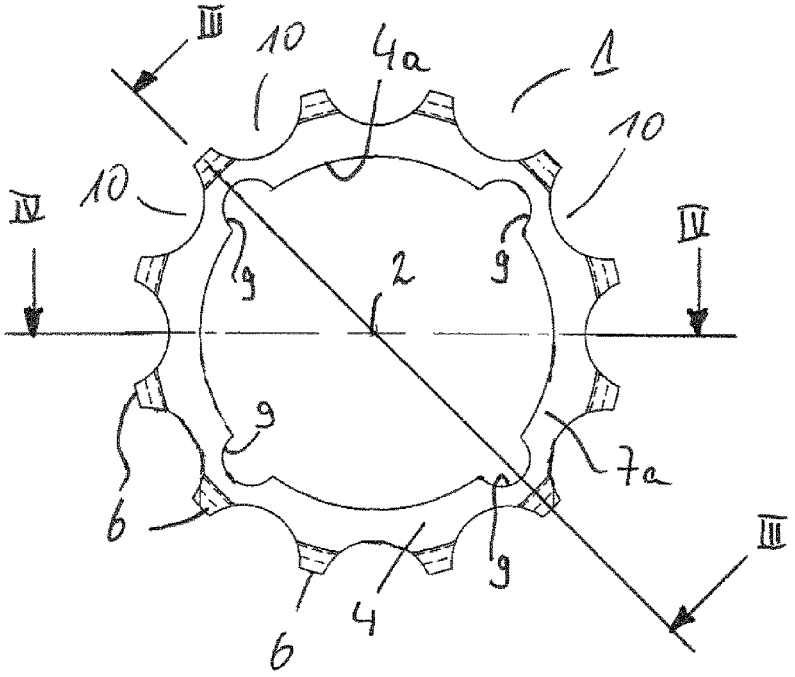
Figure 3:
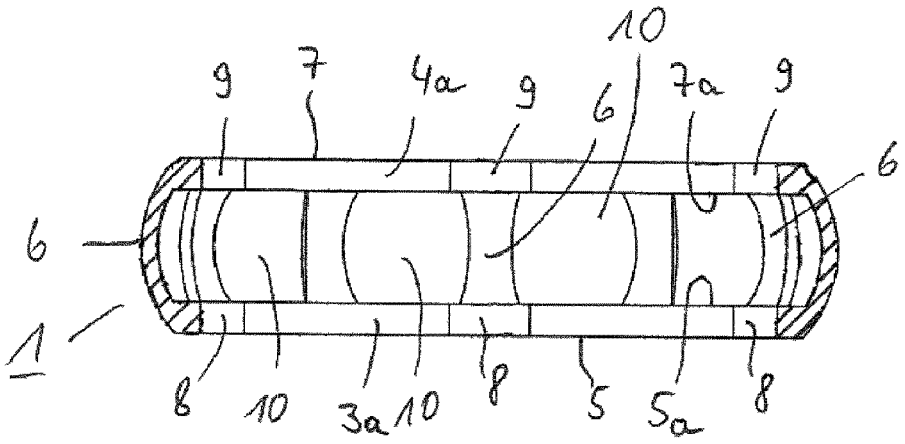
Figure 4:
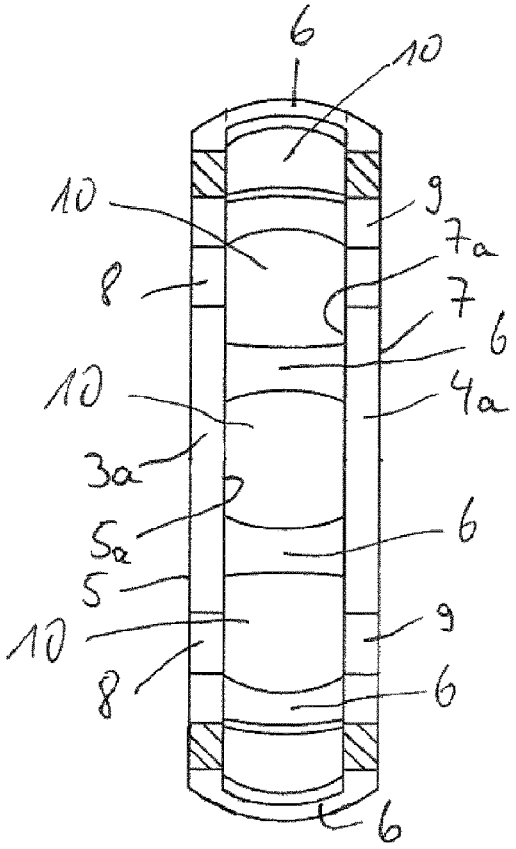
Figure 5:
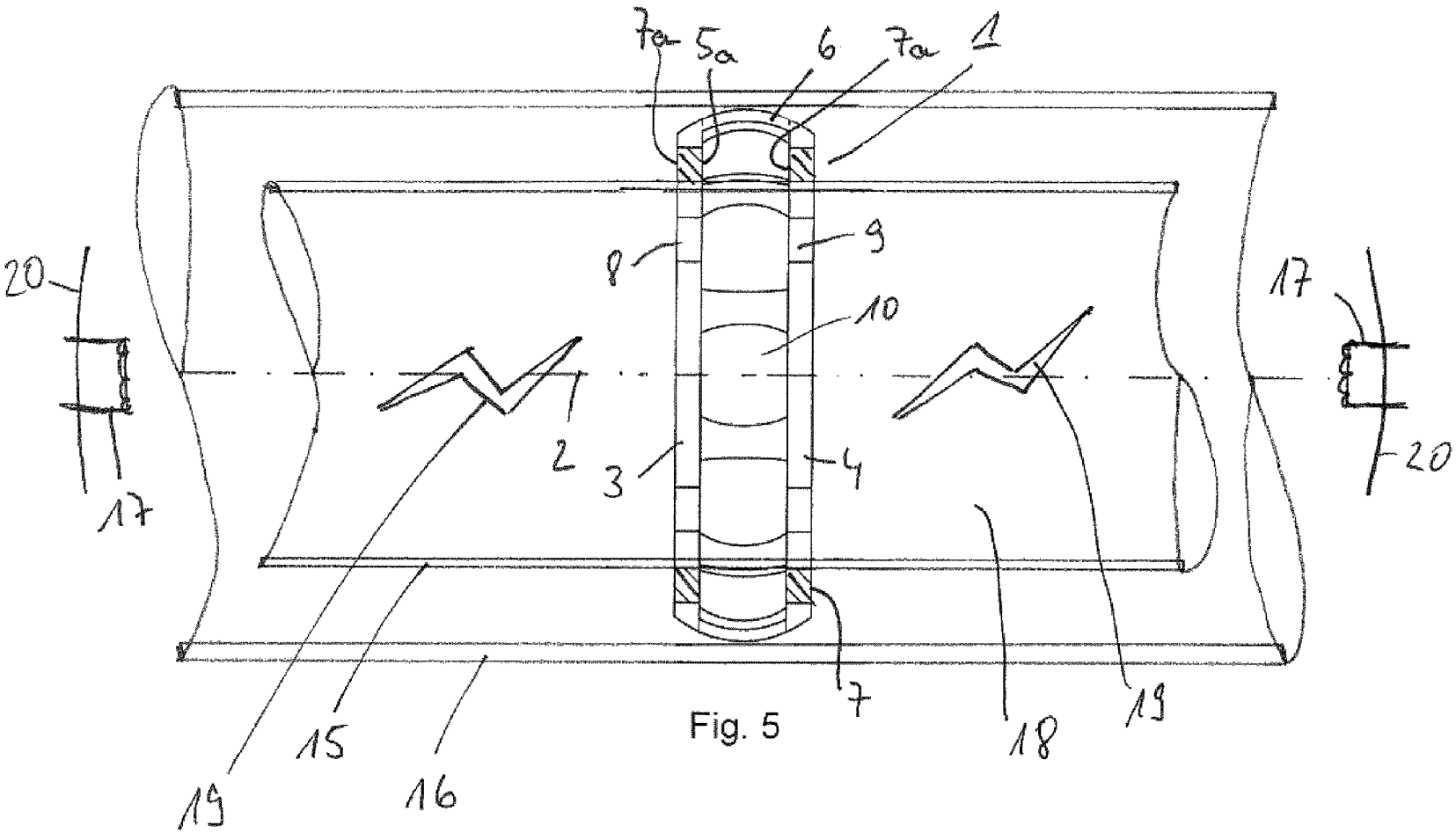

In the following, a preferred embodiment of the present invention is described with reference to the drawings, which show:

FIG. 1: a damping ring in perspective view;

FIG. 2: the damping ring of FIG. 1 as viewed in axial direction;

FIG. 3: the damping ring of FIGS. 1 and 2 in cross-section along the line III-III of FIG. 2;

FIG. 4: the damping ring of FIG. 2 in a cross-section along the line IV-IV of FIG. 2; and FIG. 5: a lamp unit in a schematic representation, in which only the section with the damping ring is shown.

DETAILED DESCRIPTION OF THE INVENTION

FIG. 1 shows a damping ring 1 according to the present invention. The ring is essentially rotationally symmetrical with respect to a longitudinal axis 2.

Due to this geometry, it is useful to define directions and distances in the context of this description such that an axial position or distance parallel to the axis 2, a radial position or distance from the axis 2, and a circumferential angular position or distance are used.

The ring comprises a first side element 3 with a first circumferential inner surface 3*a* and a second side element 4 with a second circumferential inner surface 4*a*, which face towards the axis 2. An outer face 5 faces in the direction of the axis 2 and is oriented essentially perpendicular to the inner faces 3*a* and 4*a*. The same applies to an inner face 5*a*, which faces away from the outer face 5. In radially outward direction, the outer face 5 is joined to connecting portions 6. The connecting portions 6 are, at one end, joined to the outer face 5 and, at the other end, to an outer face 7, which faces away from the outer face 5 and is oriented essentially perpendicular to the inner face 4*a*. A further inner face 7*a* is provided facing away from the outer face 7 and extends parallel to and at a distance from the inner face 5*a*.

The faces 5, 5*a*, 7 and 7*a* are essentially flat.

The connecting portions 6 are bridge- or arch-shaped and their outer surface is convex. The point of the largest radius from the axis 2 to the outer host point of outermost point of connecting portions 6 lies centrally on a plane, which is in the middle between the outer faces 5 and 7 and accordingly between the inner faces 3*a* and 4*a*.

In this preferred embodiment, the wall thickness in the area of the inner faces 3*a* and 4*a* is greater than the wall thickness of the connecting portions 6, so that, using a resilient material, the connecting portions 6 show increased flexibility.

The outer faces 5 and 6 are each provided with recesses 8 and 9. The recesses are cut out and intersect the inner faces 3*a* and 4*a* so that the inner diameter of the ring is increased in the area of the recesses 8 and 9. In this special embodiment, the recesses are of half-circular shape.

The geometric shape of the ring 1 can also be seen as a ring with a u-shaped cross-section in which the open side of the cross-section faces towards the axis 2 and the closed side of u-shape faces radially outwards. The connecting portions 6 are then produced by providing cutouts or openings 10 at the outer circumference of the body of the ring 1. In this special embodiment, there are twelve connecting portions 6, which are distributed at an equal angular distance from each other along the outer side of the ring 1. Accordingly, twelve cutouts 10 are provided at equal angular distances along the outer surface of the ring 1.

FIG. 2 shows a cross-section perpendicular to the axis 2 through the ring 1 of FIG. 1. It can be seen that the inner surface 4*a* of the rear portion of the ring 1 is circular in shape and that the recesses 9 are half-circular. The open side of the recesses 9 faces towards the central axis 2. The inner surface 4*a* is consequently intersected at angular intervals of 90°. On the outside, it can be seen that the connecting portions 6 are, starting from their radially inwardly lying bases, continuously reduced in their width to a minimum value, which is reached at the point that lies radially outward. The recesses or cutouts 10 are, in this representation, partially circular, so that they can be produced for example using a milling process in which the rotational axis of the tool is parallel to and at distance from the central axis 2.

FIG. 3 shows a cross-section along the line III-III of FIG. 2. This cross-section shows that the portion between the inner face 5*a* and the outer face 5 as well as the portion between the inner face 7*a* and the outer face 7 are of essentially uniform thickness. In contrast thereto, the connecting portion 6 is of reduced thickness.

FIG. 4 shows a cross-section along the line IV-IV of FIG. 2. Again, identical elements are designated with the same reference numerals. This cross-section does not intersect the connecting portions 6, the cross-section of FIG. 3 does, but rather intersect the ring between connecting portions 6 in the area of the openings 10.

Finally, FIG. 5 shows a schematic representation of a UV lamp unit in the section in which the damping ring 1 is provided. The cross-section of FIG. 5 shows the damping ring 1 in the orientation of FIG. 4, i.e. in cross-section along the line IV-IV of FIG. 2. Identical elements of the ring 1 are designated with the same reference numerals.

The lamp unit comprises a lamp body 15 and a sleeve 16. Only a short section of both elements is shown in FIG. 5. The lamp body 15 is sealed at both ends 20 and incorporates electrodes 17, which are provided at the sealed ends and which extend into an inner lamp volume 18, which is hermitically sealed. The volume 18 contains a gas filling, usually a noble gas with a small amount of mercury. The pressure of the gas depends on the specific construction of the lamp. As known from the prior art, a discharge 19 will be produced between the electrodes 17, if they are supplied with electric energy in an appropriate form. The gas discharge 19 finally produces the ultraviolet radiation, which can leave the lamp through the UV-transparent lamp body 15.

The lamp body 15 is surrounded by the ring 1. The ring 1 engages the outer surface of the lamp body 15 with the inner surfaces 3*a* and 4*a* of the two side elements 3 and 4. In a preferred embodiment, the inner diameter of the ring 1 and the outer diameter of the lamp body 15 are arranged so that the ring 1 is frictionally held in position on the lamp body 5.

The ring 1 and the lamp body 15 are essentially coaxially aligned with the longitudinal axis 2. The sleeve 16 surrounds the lamp body 15 and the ring 1 and is also aligned with the longitudinal axis 2, so that the lamp body 15 is essentially centred inside the sleeve 16. This is achieved by the fact that the ring 1 with its outer connecting portions 6 extends, in radial direction, to the inner surface of the sleeve 16. Depending on the choice, the outer diameter of the ring 1 in the centre of the connecting portions 6 and the inner diameter of the sleeve 16 can be matched in a way that there is some play between the ring 1 and the sleeve 16. It may be desired, that the diameters are essentially identical so that the ring just contacts the inner surface of the sleeve 16. It may also be desired that the outer diameter of the ring 1 is larger than the inner diameter of the sleeve 16, so that the ring 1 is deformed, in the area of contact, and holds the sleeve 6 frictionally. In any case, the difference between the outer diameter of the ring 1 and the inner diameter of the sleeve 16 should be small, i.e. below 1 mm and preferably below 0.5 mm.

In a preferred embodiment, the ring 1 is made from a resilient, elastic plastic material, for example PTFE. It can be machined, sintered or injection moulded.

In operation, the lamp body 1 is centred and held in the ring 1, which in turn centres the lamp body 15 and itself inside the sleeve 19. The ring 1 is preferably provided near the free end of the lamp body 15, while the other end of the lamp body 15 is held by an electric contacting device, for example a socket (not shown). The ring 1 thus centres the free end of the lamp body 15 inside the sleeve 16. Under mechanical load, the lamp body 15 transfers inertial forces to the ring 1 through the surfaces 3*a* and 4*a*. The ring 1 than transfers these forces to the sleeve 16 in the area of contact, i.e. in the connecting portions 6. These connecting portions 6 contact the sleeve tube only in small surface areas and, because of the reduced thickness of the connecting portions 6, these portions can deflect and act as a spring/damper combination. In this context, it is preferred that the material of the ring 1 absorbs some energy during a resilient deformation, as opposed to metallic springs, which usually show only little energy absorption and thus little damping effect.

Any external load like mechanical shock or vibration therefore leads to a limited movement of the lamp body 15 relative to the sleeve 16 so that no direct contact between the lamp body 15 and the sleeve 16 is possible. Forces and vibration energy are limited by or absorbed in the ring 1. The risk of damage due to heavy shocks or vibrations, which may occur in mobile applications, on ships during discharge of ballast water or in portable devices is therefore significantly reduced.

An option is to provide the lamp unit as illustrated in FIG. 5 with more than one ring 1, so that not only the free end of the lamp body 15 is supported, but also the centre or other areas of the lamp body. This may especially be useful with the so-called low-pressure mercury lamps, which usually have a length of more than 1.5 meters. The embodiment with one ring 1 at the free end may be preferred in applications of so-called medium-pressure mercury lamps, which have shorter lamp bodies.

The electrodes 17 need to be contacted for starting the lamp and operating the lamp. In most applications, the lamp is contacted only from one end, so that the electric connection from the electrode 17 is made by wires (not shown) which run from the free end of the lamp body 17 to the other end, which is held by the electric socket. The wires run between the lamp body 15 and the sleeve 16. They may be guided through the recesses 8 and 9 of the ring 1, which in this way also facilitate the fixing and positioning of these wires.

The invention claimed is:

1. A UV radiator unit comprising:

an elongated gas discharge lamp with a substantially cylindrical UV transparent lamp body having sealed ends for enclosing a gas volume, wherein the lamp body defines a longitudinal axis and has an outer diameter, a UV transparent sleeve tube having an inner diameter that surrounds the lamp body and wherein the inner diameter is larger than the outer diameter of the lamp body, and at least one damping ring interposed between the lamp body and the sleeve tube, the damping ring comprising a first side element, a second side element that is separated by an axial distance in direction of the longitudinal axis from the first side element, a plurality of connecting portions that physically connect the first side element and the second side element, and openings between the connecting portions that allow for transmission of UV light in a radial direction from the lamp body to the sleeve tube.

2. The UV radiator unit according to claim 1, wherein the damping ring has at least one radially inwardly facing surface which frictionally engages an outer surface of the lamp body.

3. The UV radiator unit according to claim 1, wherein the connecting portions constitute portions of a largest diameter of the damping ring.

4. The UV radiator unit according to claim 1, wherein either the connecting portions contact the sleeve tube or a gap of less than 1 mm is disposed between the connecting portions and an inner surface of the sleeve tube.

5. The UV radiator unit according to claim 1, wherein frictional engagement between the damping ring and the lamp body is balanced against frictional engagement between the damping ring and the sleeve tube such that static friction between the damping ring and the lamp body is larger than static friction between the damping ring and the sleeve tube.

6. The UV radiator unit according to claim 1, wherein the connecting portions are arch-shaped and attached to the respective side elements, wherein the connecting portions have a basic width in a circumferential direction, and the basic width of the connecting portions has a minimum value at a point that is located centrally between the two side elements.

7. The UV radiator unit according to claim 6, wherein a point of minimum width of the connecting portions is also the point of a maximum outer diameter of the ring.

8. The UV radiator unit according to claim 1, wherein radially inwardly facing surfaces of the damping ring include recesses that constitute spaces in which the radially inwardly facing surfaces do not contact the lamp body.

9. The UV radiator unit of claim 1, wherein each opening extends to the inner diameter of the sleeve tube.

10. The UV radiator unit of claim 1, wherein each opening exposes the sleeve tube to the lamp.

11. The UV radiator unit of claim 1, wherein each opening extends to an outer diameter of the damping ring.

12. A damping ring that is configured to be positioned in a gap between a lamp body having a longitudinal axis and a sleeve tube of an ultraviolet radiator unit for centering said lamp body in said sleeve tube, the damping ring comprising:

a first side element, a second side element that is separated by an axial distance in direction of the longitudinal axis from the first side element, a plurality of connecting portions that physically connect the first side element and the second side element, and openings disposed between the connecting portions that allow for transmission of UV light in a radial direction from the lamp body to the sleeve tube.

13. The damping ring according to claim 12, wherein the connecting portions constitute portions of a largest outer diameter of the ring.

14. The damping ring according to claim 12, wherein the connecting portions are arch-shaped and attached to the respective side elements, wherein the connecting portions have a basic width in a circumferential direction, and a width of the connecting portions has a minimum value at a point that is located centrally between the two side elements.

15. The damping ring according to claim 12, wherein a point of minimum width of the connecting portions is also the point of a maximum outer diameter of the damping ring.

16. The damping ring according to claim 12, wherein radially inwardly facing surfaces of the damping ring include recesses which constitute spaces in which the radially inwardly facing surfaces do not contact the lamp body.

17. The damping ring of claim 12, wherein each opening extends to the inner diameter of the sleeve tube.

18. The damping ring of claim 12, wherein each opening exposes the sleeve tube to the lamp.

19. The damping ring of claim 12, wherein each opening extends to an outer diameter of the damping ring.

* * * * *